US011838737B2

(12) United States Patent
Wang et al.

(10) Patent No.: US 11,838,737 B2
(45) Date of Patent: Dec. 5, 2023

(54) SILICON MICROPHONE AND METHOD FOR MANUFACTURING SAME

(71) Applicant: AAC Kaitai Technologies (Wuhan) CO., LTD, China (CN)

(72) Inventors: Kaijie Wang, Shenzhen (CN); Linlin Wang, Shenzhen (CN); Zhuanzhuan Zhao, Shenzhen (CN)

(73) Assignee: AAC KAITAI TECHNOLOGIES (WUHAN) CO., LTD, Wuhan (CN)

( * ) Notice: Subject to any disclaimer, the term of this patent is extended or adjusted under 35 U.S.C. 154(b) by 8 days.

(21) Appl. No.: 17/535,714

(22) Filed: Nov. 26, 2021

(65) Prior Publication Data

US 2022/0174422 A1 Jun. 2, 2022

(30) Foreign Application Priority Data

Nov. 30, 2020 (CN) ..... 202011380674.0

(51) Int. Cl.
*H04R 9/08* (2006.01)
*H04R 31/00* (2006.01)

(52) U.S. Cl.
CPC ..... *H04R 9/08* (2013.01); *H04R 31/00* (2013.01); *H04R 2201/003* (2013.01)

(58) Field of Classification Search
CPC ..... H04R 19/005; H04R 2201/003; H04R 19/04; H04R 1/04; H04R 19/016; H04R 17/02; H04R 9/08; H04R 31/00
USPC ..... 381/174, 175, 111, 369, 361, 355, 122, 381/191, 113, 91; 257/416; 438/53; 29/594
See application file for complete search history.

(56) References Cited

U.S. PATENT DOCUMENTS

2009/0202089 A1* 8/2009 Zhang ..... H04R 1/222 381/174

* cited by examiner

*Primary Examiner* — Norman Yu
(74) *Attorney, Agent, or Firm* — W&G Law Group

(57) ABSTRACT

The present invention provides a vibration motor including a housing with an accommodation space, a vibration member and a fixed member accommodated in the accommodation space, and an elastic support member suspending the vibration member. The elastic support member has an elastic arm, a first fixed part, and a second fixed part. Both the first fixed part and the second fixed part are bent toward the same side of the elastic arm, and the vibration member is located between the first fixed part and the second fixed part. The elastic stress of the elastic support member is effectively improved and the service life of the elastic support member is improved.

6 Claims, 5 Drawing Sheets

SILICON MICROPHONE AND METHOD FOR MANUFACTURING SAME

FIELD OF THE PRESENT DISCLOSURE

The present invention relates to the technical field of microphones, in particular to a silicon microphone and a method for manufacturing such a silicon microphone.

DESCRIPTION OF RELATED ART

At present, a microphone with more applications and better performance is the Micro-Electro-Mechanical-System Microphone (MEMS Microphone). Such a MEMS microphone is made of silicon-based semiconductor materials, so it is also called silicon-based microphone or silicon microphone. The packaging volume of a MEMS microphone is smaller than traditional electret microphones, and its applications are becoming wider and wider.

As shown in FIG. 1, a related silicon microphone comprises a base 91 and a capacitor system arranged on and insulated from the base 91. The capacitor system comprises a diaphragm 92 and a backplate 93 spaced apart from the diaphragm 92 to form a rear cavity. A narrow gap 924 is designed on the diaphragm 92. The backplate 93 is provided with a through hole. A back cavity 94 is formed in a center of the base 91. An insulation layer is provided respectively between the base 91 and the diaphragm 92, and between the diaphragm 92 and the backplate 93.

The low frequency attenuation of a microphone is an important performance indicator of the microphone. Reducing low-frequency attenuation can also reduce microphone noise. When the diaphragm designed with "legs" is used, it is inevitable to design a narrow gap on the diaphragm to form a deflation slot. The air flow enters the rear cavity from the front cavity where the back cavity is located through the deflation slot, thereby increasing the low frequency attenuation.

Therefore, it is necessary to provide a silicon microphone that can reduce low-frequency attenuation.

SUMMARY OF THE PRESENT INVENTION

One of the objects of the present invention is to provide a silicon microphone capable of reducing low frequency attenuation, and avoiding diaphragm jamming in the back cavity or sticking to the backplate.

To achieve the above-mentioned object, the present invention provides a silicon microphone comprising: a base with a back cavity formed in a middle thereof; a capacitor system arranged on and insulatively connected to the base, comprising a diaphragm having a vibration part and a fixed part surrounding a periphery of the vibration part; a backplate forming a distance from the diaphragm, the backplate including a through hole; and a narrow gap formed between the vibration part and the fixed part. A barrier wall extends along a vibration direction of the diaphragm; wherein the silicon microphone further includes: a first space formed between the narrow gap and the back cavity, and included in a first vibration space which is defined between the diaphragm and the base opposite to the diaphragm; and/or a second space formed between the narrow gap and the through hole of the backplate closest to the narrow gap, and included in a second vibration space which is defined between the diaphragm and the backplate.

In addition, the barrier wall comprises at least one of a first barrier wall, a second barrier wall, a third barrier wall, and a fourth barrier wall; the first barrier wall is arranged on an upper surface of the base; the second barrier wall is arranged on a lower surface of the diaphragm; the third barrier wall is arranged on an upper surface of the diaphragm; the fourth barrier wall is arranged on a lower surface of the backplate; the first barrier wall and the second barrier wall are located in the first space, and the third barrier wall and the fourth barrier wall are located in the second space.

Further, at least one of the first barrier wall, the second barrier wall, the third barrier wall, and the fourth barrier wall is composed of one or more of the circular walls.

Further, the circular wall is an uninterrupted continuous wall, or the circular wall is composed of a multi-section wall with gaps.

Further, along the vibration direction of the diaphragm, the first barrier wall and the second barrier wall are staggered from each other, and the third barrier wall and the fourth barrier wall are staggered from each other; the first barrier wall is close to the back cavity, and the second barrier wall and the fourth barrier wall are close to the narrow gap; the third barrier wall is close to the through hole on the backplate.

Further, a relationship between a height h1 of the first barrier wall, a height h2 of the second barrier wall, and a distance L1 between the lower surface of the diaphragm and the upper surface of the base is: $L1/3 \leq h1 \leq 2 \times L1/3$, $L1/3 \leq h2 \leq 2 \times L1/3$, $L1=h1+h2$.

Or, a relationship between a height h3 of the third barrier wall, a height h4 of the fourth barrier wall and a distance L2 between the upper surface of the diaphragm and the lower surface of the backplate is: $L2/3 \leq h3 \leq 2 \times L2/3$, $L2/3 \leq h4 \leq 2 \times L2/3$, $L2=h3+h4$.

The present invention further provides a method for manufacturing a silicon microphone as described above, comprising steps of:

a. depositing a silicon oxide layer on upper surface of a structural layer, and etching a silicon oxide layer where a barrier wall is needed for forming a groove;
b. depositing polysilicon on the silicon oxide layer;
c. removing the polysilicon etching outside the groove position;
d. releasing the silicon oxide layer, so that the polysilicon retained at the groove position forms a barrier wall; wherein the barrier wall is located on the upper surface of the structural layer; and, the structural layer serves as the base or the diaphragm.

In addition, the present invention provides another method for manufacturing a silicon microphone, including steps of:

a. depositing a first layer of silicon oxide on upper surface of a first structural layer, and etching a silicon oxide layer where the barrier wall is needed to form a first groove;
b. continuing to deposit a second layer of silicon oxide on the first layer of silicon oxide, wherein a second groove is formed at a position of the second layer of silicon oxide corresponding to the first groove;
c. depositing a second structural layer on the second layer of silicon oxide;
d. releasing the first layer of silicon oxide and the second layer of silicon oxide, wherein the second structural layer is deposited on the second groove to form the barrier wall, and the barrier wall is located on the lower surface of the second structural layer;

wherein, the first structural layer serves as the base, and the second structural layer serves as the diaphragm; or the first structural layer serves as the diaphragm, and the second structural layer serves as the backplate.

In addition, the present invention provides a method for manufacturing a silicon microphone, including steps of:

a. depositing a first layer of silicon oxide on the upper surface of the first structural layer, and etching a first layer of silicon oxide at the position where a Type A barrier wall is needed to form a first groove;

b. depositing polysilicon on the first layer of silicon oxide;

c. removing the polysilicon outside the position of the first groove by etching, wherein the polysilicon remaining at the first groove position forms a Type A barrier wall, and the Type A barrier wall is located on the upper surface of the first structural layer;

d. etching a first layer of silicon oxide at the position where a Type B barrier wall needs to be set to form a second groove;

e. continuing to deposit a second layer of silicon oxide on the first layer of silicon oxide, and forming a third groove at the position corresponding to the second groove of the second layer of silicon oxide;

f. depositing a second structural layer on the second layer of silicon oxide;

g. releasing the first layer of silicon oxide and the second layer of silicon oxide, wherein the deposition of the second structural layer forms a Type B barrier wall in the third groove; and the Type B barrier wall is located on the lower surface of the second structural layer;

wherein, the first structural layer serves as the base, and the second structural layer serves as the diaphragm; or, the first structural layer serves as the diaphragm, and the second structural layer serves as the backplate.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to exemplary embodiments. To make the technical problems to be solved, technical solutions and beneficial effects of the present disclosure more apparent, the present disclosure is described in further detail together with the figures and the embodiments. It should be understood the specific embodiments described hereby is only to explain the disclosure, not intended to limit the disclosure.

Figure 1:
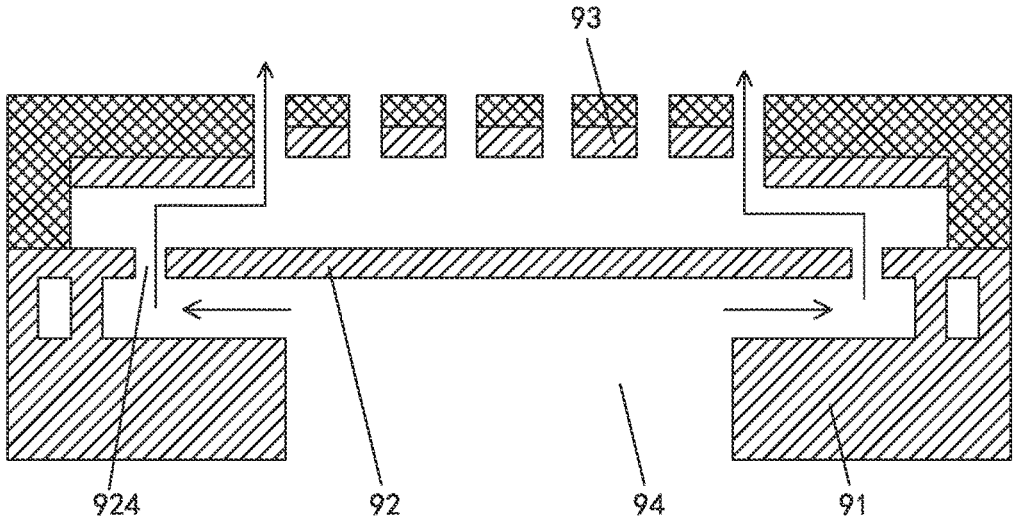
FIG. 1 (Related Art)
FIG. 1 is a cross-sectional structural view of a silicon microphone of a related art.
Figure 2:
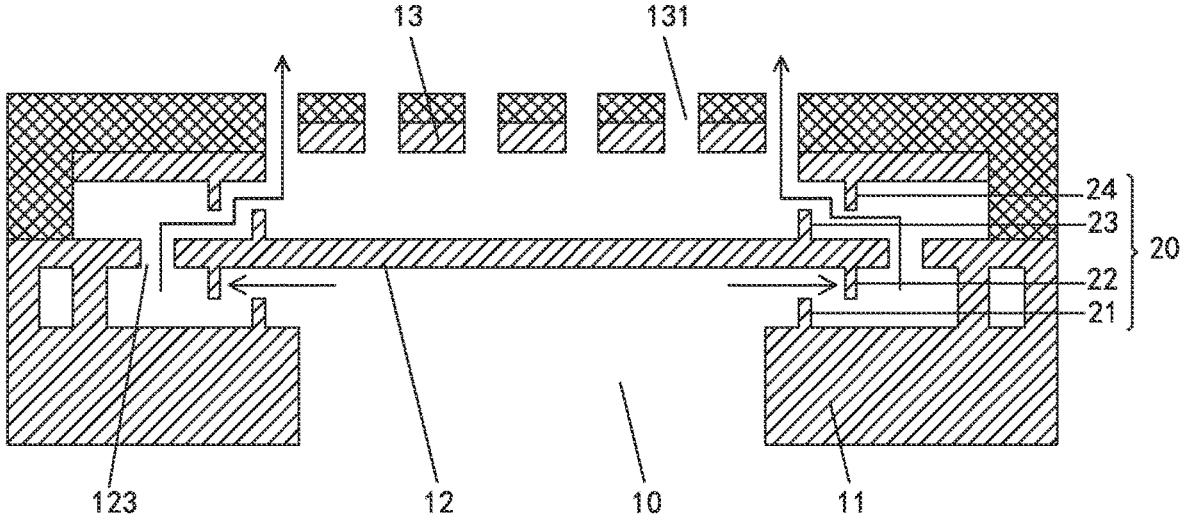
FIG. 2 is a cross-sectional structural view of a silicon microphone in accordance with an exemplary embodiment of the present invention.
Figure 3:
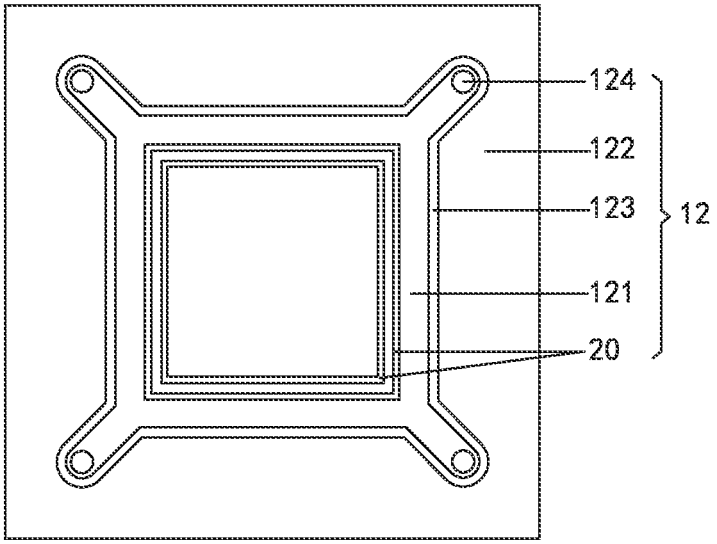
FIG. 3 is a structural view of a diaphragm used in the silicon microphone in FIG. 2.
Figure 4:
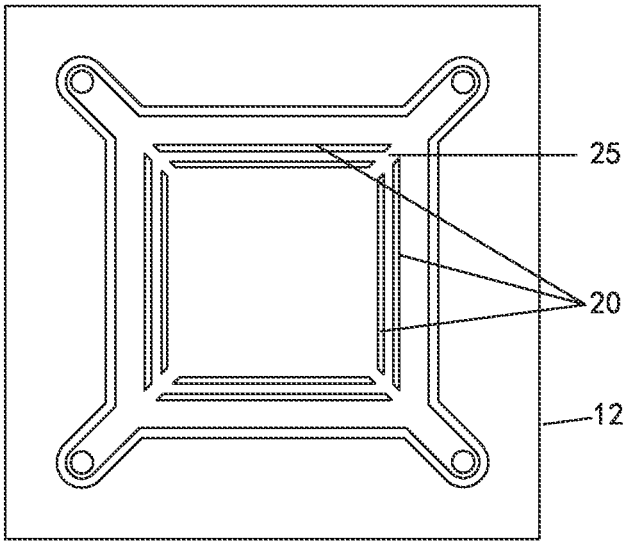
FIG. 4 is a structural view of another exemplary diaphragm used in a silicon microphone in FIG. 2.

Please refer to FIGS. 2-4, an embodiment of the present invention provides a silicon microphone, which comprises a base 11 with a back cavity 10 formed in a middle thereof, and a capacitor system arranged on the base 11 and insulated from the base 11. The capacitor system comprises a diaphragm 12 and a backplate 13 forming a distance from the diaphragm 12. The backplate 13 is provided with a through hole 131. The diaphragm 12 comprises a vibration part 121 in the middle and a fixed part 122 surrounding the periphery of the vibration part 121. The vibration part 121 and the fixed part 122 are separated by a narrow gap 123 therebetween. The fixed part 122 is insulated and connected to the base 11, and the vibration part 122 is insulated and connected to the base 11 through a plurality of anchor parts 124.

Wherein, the base 11 is made of silicon-based semiconductor materials, referred to as silicon base or base for short. The diaphragm 12 can be rectangular, circular, oval and other shapes. The diaphragm 12 is connected to base 11 through a first insulation layer. The backplate 13 and the diaphragm 12 are separated by a second insulation layer to form an insulation gap. Multiple through holes 131 can be provided on the backplate 13 to connect with the external environment.

When the silicon microphone is powered on, the backplate 13 and diaphragm 12 will carry charges of opposite polarities to form a capacitor. When the diaphragm 12 vibrates under the action of sound waves, the distance between the diaphragm 12 and the backplate 13 will change, which will cause the capacitance of the capacitor system to change, and then convert the sound wave signal into an electrical signal to realize the corresponding function of the microphone.

Wherein, the gap between the diaphragm 12 and the base 11 directly opposite forms a first vibration space. The gap between the diaphragm 12 and the backplate 13 forms a second vibration space, and the diaphragm vibrates in the first vibration space and the second vibration space. Taking the diaphragm 12 as the boundary, the internal and external space of the silicon microphone is divided into two parts, wherein the space on the side of the back cavity 10 is called the front cavity, and the space on the side of the backplate 13 is called the rear cavity. When the diaphragm 12 vibrates, the front cavity and the rear cavity are connected through the narrow gap 123, and the narrow gap 123 becomes a deflation slot. The airflow from the front cavity enters the rear cavity through the narrow gap 123, which causes the low frequency attenuation of the silicon microphone to increase.

In order to reduce the low frequency attenuation, the silicon microphone of the present invention is designed with a barrier wall 20 to increase the damping of the narrow gap. The barrier wall 20 generates a damping effect on the air flow entering the rear cavity through the narrow gap 123 in the front cavity, thereby reducing low frequency attenuation. The barrier wall 20 of the silicon microphone of the present invention is designed in the first space and/or the second space and extends along the vibration direction of the diaphragm 12. The first space refers to: The space area between the narrow gap 123 and the back cavity 10 in the first vibration space, that is, the overlap area between the diaphragm 12 and the base 11 directly opposite to it. The second space refers to: The space area between the narrow gap 123 and the through hole 131 of the backplate 13 that is closest to the narrow gap 123 in the second vibration space corresponds to the first space in the vibration direction of the diaphragm 12.

It is easy to understand that the back cavity 10 is connected to the narrow gap 123 through the first space, and the through hole 123 on the backplate 13 is connected to the narrow gap 123 through the second space. When the airflow of the front cavity enters the rear cavity through the narrow gap 123, it will inevitably pass through the first space and the second space. Therefore, by setting the barrier wall in the first space and the second space, an effective damping effect on the airflow can be achieved.

The barrier wall 20 in the first space can be designed on the lower surface of diaphragm 12, the upper surface of base 11, or both the lower surface of diaphragm 12 and the upper surface of base 11. The barrier wall 20 in the first space can not only reduce the low frequency attenuation, but also prevent the diaphragm 12 from being stuck in the back cavity 10 when the vibration amplitude of the diaphragm 12 is too large.

The barrier wall 20 in the second space can be designed on the upper surface of the diaphragm 12, the lower surface of the backplate 13, or both the upper surface of the diaphragm 12 and the lower surface of the backplate 13. The barrier wall 20 in the second space can not only reduce the low frequency attenuation, but also prevent the diaphragm 12 from sticking to the backplate 13 when the vibration amplitude is too large.

Herein, the barrier wall provided on the upper surface of the base 11 is called a first barrier wall 21. The barrier wall provided on the lower surface of the diaphragm is called a second barrier wall 22. The barrier wall provided on the upper surface of the diaphragm is called a third barrier wall 23. The barrier wall provided on the lower surface of the backplate is called a fourth barrier wall 24. For the above four or four-layer barrier wall 20, only one of the actual silicon microphones can be designed, or multiple or all of them can be designed.

Any one of the first barrier wall, the second barrier wall, the third barrier wall, and the fourth barrier wall is composed of one or more of the circular walls. Please refer to FIG. 3 or FIG. 4, taking the barrier wall 20 designed on the diaphragm 12 as an example, the barrier wall 20 designed on a certain surface may include, for example, two circular walls. The circular wall may be an uninterrupted continuous wall, as shown in FIG. 3; or, it may also be composed of a multi-section wall with gaps 25, as shown in FIG. 4. Optionally, the circular wall may be a wall with a regular shape or a wall with an irregular shape. For example, folds protruding to both sides in turn, etc., as long as it can have a damping effect on the airflow, a specific shape of the wall is not limited.

Optionally, in the vibration direction of the diaphragm 12, the first barrier wall 21 and the second barrier wall 22 are staggered from each other, and the third barrier wall 23 and the fourth barrier wall 24 are staggered from each other. Further, the first barrier wall 21 may be closer to the back cavity 10 than the second barrier wall 22. The second barrier wall 22 may be closer to the narrow gap 123 than the first barrier wall 21. The third barrier wall 23 may be closer to the through hole on the backplate than the fourth barrier wall 24. The fourth barrier wall 24 may be closer to the narrow gap 123 than the third barrier wall 23. In this way, the flow path of the airflow passing through the narrow gap 123 is more tortuous, and the damping effect is stronger.

In the embodiment of the present invention, remember that the height of the first barrier wall is h1, the height of the second barrier wall is h2, and the distance between the lower surface of the diaphragm 12 and the upper surface of the base 11 is L1, then, optionally, the relationship among the three is: $L1/3 \le h1 \le 2 \times L1/3$, $L1/3 \le h2 \le 2 \times L1/3$, $L1 \le h1+h2$. Preferably, $L1=h1+h2$. By limiting the above-mentioned parameter relationship, it is possible to ensure that the barrier wall in the first space has a better damping effect.

In the embodiment of the present invention, the height of the third barrier wall is h3, the height of the fourth barrier wall is h4, and the distance between the upper surface of the diaphragm 12 and the lower surface of the backplate 13 is L2. Optionally, the relationship among the three can be: $L2/3 \le h3 \le 2 \times L2/3$, $L2/3 \le h4 \le 2 \times L2/3$, $L2 \le h3+h4$. Preferably, $L2=h3+h4$. By limiting the above-mentioned parameter relationship, it is possible to ensure that the barrier wall in the second space has a better damping effect.

The present invention provides a silicon microphone, which reduces low frequency attenuation by designing a barrier wall in the first vibration space between the diaphragm and the base and/or the second vibration space between the diaphragm and the backplate. Specifically, the barrier wall can be added to the first space area where diaphragm 12 and base 11 overlap in the first vibration space. In this way, the acoustic damping of the narrow gap 123 is increased, thereby reducing the low attenuation. At the same time, this can prevent the diaphragm 12 from getting stuck in the back cavity 10. It is also an option to add a barrier wall in the second vibration space, in a second space area between the narrow gap 123 of the diaphragm 12 and the through hole 131 of the backplate 13 closest to the narrow gap 123, so as to increase the acoustic damping of the narrow gap 123, thereby reducing the low attenuation, while preventing the diaphragm 12 from sticking to the backplate 13. The barrier wall may be multiple closed circular walls, or a discontinuous multi-section wall. It can be a regular-shaped wall or an irregular-shaped wall, such as folds protruding upward and downward.

The present disclosure also provides a method for manufacturing the above-mentioned silicon microphone.

Figure 5:
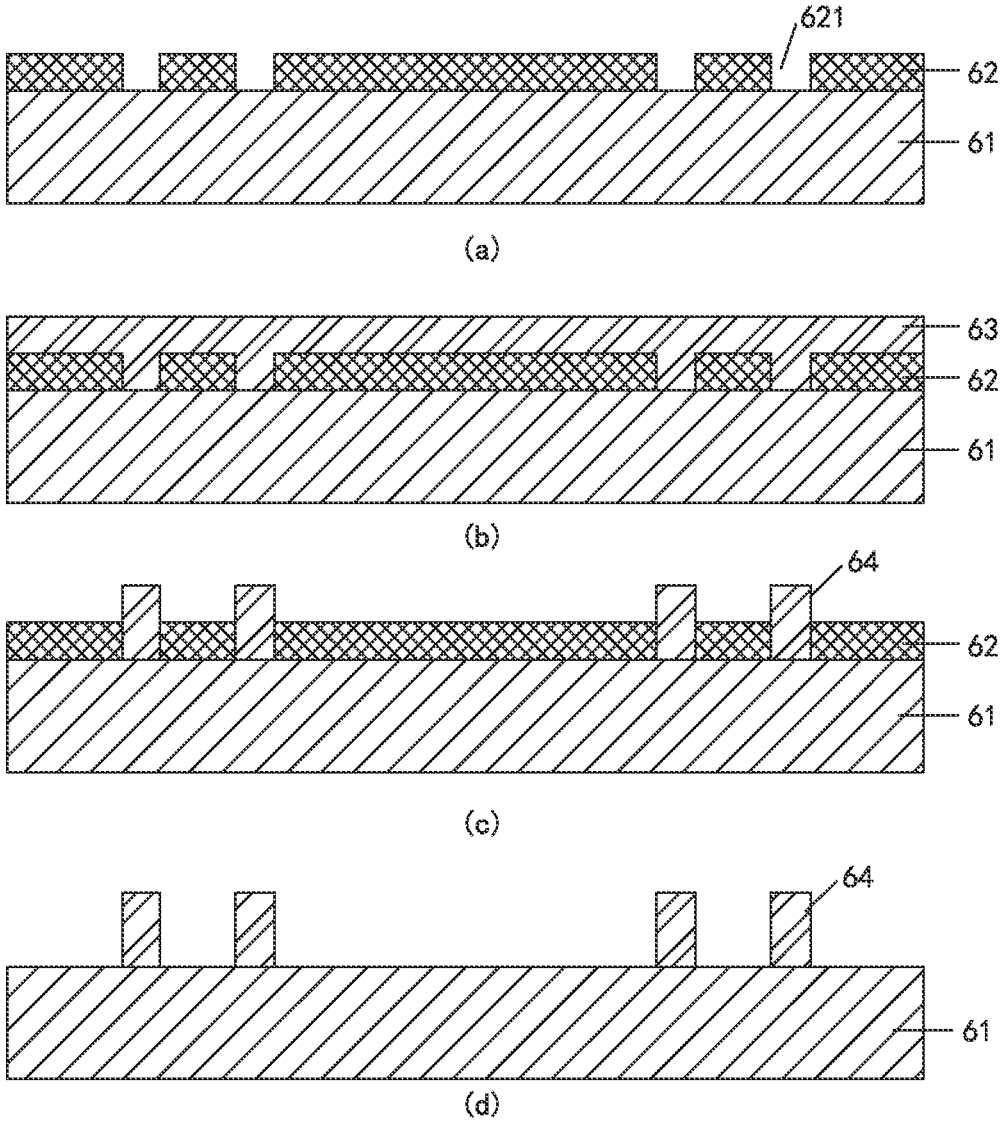
FIG. 5 is a flowchart of a method for manufacturing the silicon microphone in FIG. 2.

Please refer to FIG. 5, an embodiment of the present invention provides a method includes the following steps:

a. As shown in FIG. 5(*a*), a silicon oxide layer 62 is deposited on the upper surface of the structural layer 61, and the silicon oxide layer is etched where a barrier wall is needed to form a groove 621. Wherein, the structural layer 61 may be, for example, a base made of silicon-based semiconductor material or a diaphragm made of polysilicon material.
b. As shown in FIG. 5(*b*), polysilicon 63 is deposited on the silicon oxide layer 62; optionally, polysilicon can be deposited by LPCVD (Low Pressure Chemical Vapor Deposition) process.
c. As shown in FIG. 5(*c*), remove the polysilicon 63 outside the groove 621 position by etching;
d. As shown in FIG. 5(*d*), release the silicon oxide layer 62, so that the polysilicon retained at the groove 621 position forms a barrier wall 64, the barrier wall 64 is located on the upper surface of the structural layer 61. Wherein, BOE (buffered oxide etch) can be used to release the silicon oxide layer 62. The silicon oxide layer 62 here is equivalent to a sacrificial layer.

This method can be used to process a barrier wall on the upper surface of a structural layer such as the base or diaphragm of a silicon microphone, such as the first barrier wall and third barrier wall described above.

Figure 6:
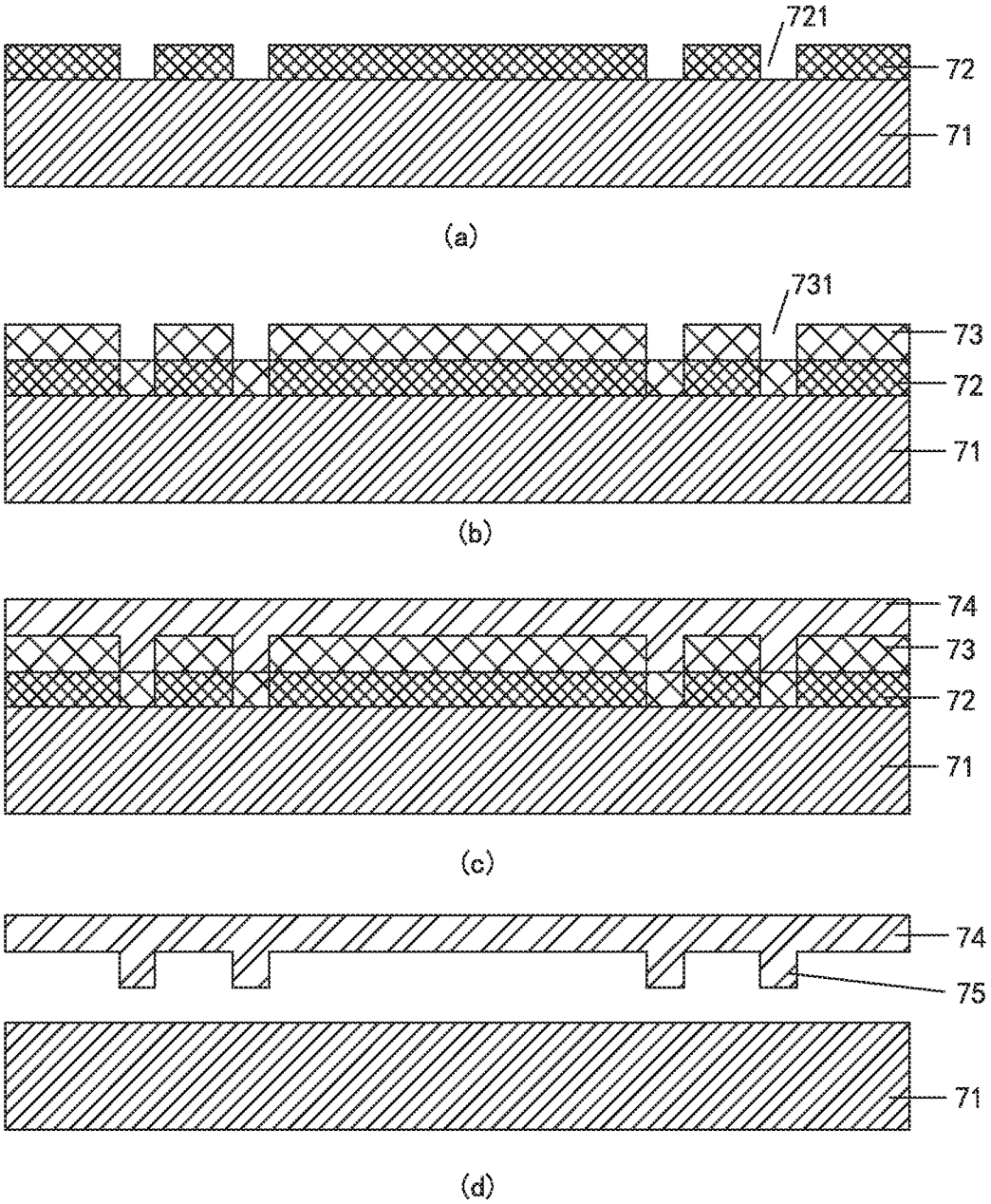
FIG. 6 is a flowchart of another exemplary method for manufacturing the silicon microphone in FIG. 2.

Please refer to FIG. 6, an embodiment of the present invention provides another exemplary method includes the following steps:

a. As shown in FIG. 6(*a*), a first layer of silicon oxide 72 is deposited on the upper surface of the first structural layer 71, and the silicon oxide layer 72 is etched where a barrier wall is needed to form a first groove 721.

b. As shown in FIG. 6(*b*), a second layer of silicon oxide 73 is continuously deposited on the first layer of silicon oxide 72, and the second layer of silicon oxide 73 is formed at a position corresponding to the first groove 721 to form a second groove 731.

c. As shown in FIG. 6(*c*), deposit a second structural layer 74 on the second layer of silicon oxide 73;

d. Then, release the first layer of silicon oxide 72 and the second layer of silicon oxide 73. In this way, the deposition of the second structural layer 74 on the second groove 731 forms a barrier wall 75, and the barrier wall 75 is located on the lower surface of the second structural layer 74.

Wherein, PECVD (plasma enhanced chemical vapor deposition) process can be used to deposit silicon oxide. The LPCVD process can be used to deposit the second structural layer. The second structural layer can be, for example, polysilicon or silicon nitride (SiN). BOE can be used to release the silicon oxide layer. The silicon oxide layer here is equivalent to a sacrificial layer.

Wherein, the first structural layer is the base, and the second structural layer is the diaphragm. The first structural layer is the diaphragm, and the second structural layer is the backplate.

Wherein, the first structural layer may be, for example, a base made of silicon-based semiconductor material, and the second structural layer may be, for example, a diaphragm made of polysilicon material. Alternatively, the first structural layer may be, for example, a diaphragm made of polysilicon, and the second structural layer may be, for example, a backplate made of polysilicon or silicon nitride.

This method can be used to process a barrier wall on the lower surface of a structural layer such as a diaphragm or backplate of a silicon microphone, such as the second barrier wall and the fourth barrier wall described above.

Figure 7:
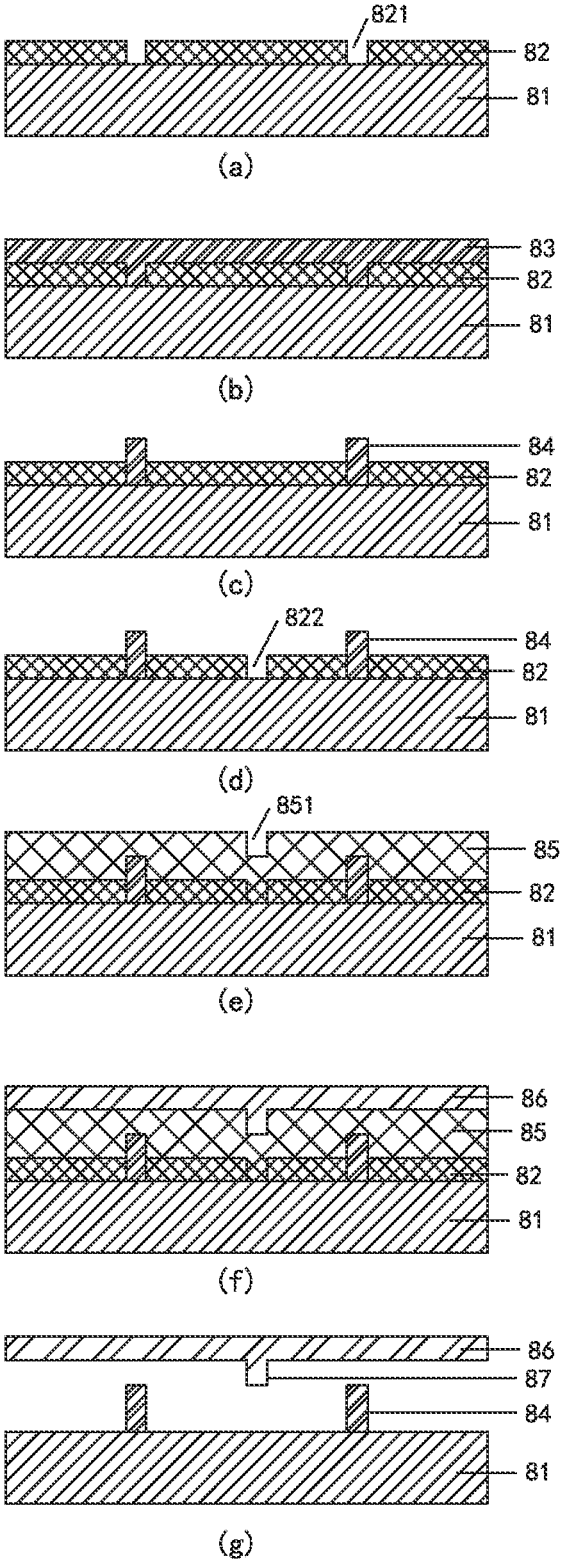
FIG. 7 is a flowchart of another exemplary method for manufacturing the silicon microphone in FIG. 2.

Please refer to FIG. 7, an embodiment of the present invention provides yet another method including the following steps:

a. As shown in FIG. 7(*a*), deposit the first layer of silicon oxide 82 on the upper surface of the first structural layer 81, and etch the first layer of silicon oxide 82 at the position where the Type a barrier wall is needed to form a first groove 821. The Type a barrier wall refers to the barrier wall to be formed on the upper surface of the first structural layer 81.

b. As shown in FIG. 7(*b*), deposit polysilicon 83 on the first layer of silicon oxide 82.

c. As shown in FIG. 7(*c*), remove the polysilicon 83 outside the first groove position 821 by etching. In this way, the polysilicon 83 remaining at the position of the first groove 821 forms a Type a barrier wall 84, and the Type a barrier wall 84 is located on the upper surface of the first structural layer 81.

d. As shown in FIG. 7(*d*), the first layer of silicon oxide 82 is etched at the position where the Type B barrier wall needs to be set to form a second groove 822. The Type B barrier wall refers to the barrier wall to be formed on the lower surface of the second structural layer.

e. As shown in FIG. 7(*e*), the second layer of silicon oxide 85 is continuously deposited on the first layer of silicon oxide 82, and a third groove 851 is formed at the position of the second layer of silicon oxide 85 corresponding to the second groove 822.

f. As shown in FIG. 7(*f*), deposit a second structural layer 86 on the second layer of silicon oxide 85;

g. Then, as shown in FIG. 7(*g*), release the first layer of silicon oxide 82 and the second layer of silicon oxide 85. In this way, the part of deposition of the second structural layer 86 on the third groove 851 forms a Type B barrier wall 87. The Type B barrier wall 87 is located on the lower surface of the second structural layer 86.

Wherein, the PECVD process can be used to deposit silicon oxide. The LPCVD process can be used to deposit polysilicon or the second structural layer, and the second structural layer can be, for example, polysilicon or silicon nitride (SiN). BOE can be used to release the silicon oxide layer. The silicon oxide layer here is equivalent to a sacrificial layer.

Wherein, the first structural layer may be, for example, a base made of silicon-based semiconductor material, and the second structural layer may be, for example, a diaphragm made of polysilicon material. Or, the first structural layer is a diaphragm made of polysilicon, and the second structural layer is a backplate made of polysilicon or silicon nitride.

This method can be used to process barrier walls on the upper surface of the base of the silicon microphone and the lower surface of the diaphragm of the same at the same time, such as the first barrier wall and the second barrier wall described above. Alternatively, this method can be used to process barrier walls on the upper surface of the diaphragm of the silicon microphone and the lower surface of the backplate of the same at the same time, such as the third barrier wall and the fourth barrier wall described above.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A silicon microphone comprising:

a base with a back cavity formed in a middle thereof;

a capacitor system arranged on and insulatively connected to the base, comprising a diaphragm having a vibration part and a fixed part surrounding a periphery of the vibration part;

a backplate forming a distance from the diaphragm, the backplate including a through hole; and a narrow gap formed between the vibration part and the fixed part;

a barrier wall extending along a vibration direction of the diaphragm; wherein the silicon microphone further includes:

a first space formed between the narrow gap and the back cavity, and included in a first vibration space which is defined between the diaphragm and the base opposite to the diaphragm; and a second space formed between the narrow gap and the through hole of the backplate closest to the narrow gap, and included in a second vibration space which is defined between the diaphragm and the backplate, wherein the barrier wall comprises at least one of a first barrier wall, a second barrier wall, a third barrier wall, and a fourth barrier wall; the first barrier wall is arranged on an upper surface of the base; the second barrier wall is arranged on a lower surface of the diaphragm; the third barrier wall is arranged on an upper surface of the diaphragm; the fourth barrier wall is arranged on a lower surface of the backplate; the first barrier wall and the second barrier wall are located in the first space, and the third barrier wall and the fourth barrier wall are located in the second space.

2. The silicon microphone as described in claim 1, wherein:

at least one of the first barrier wall, the second barrier wall, the third barrier wall, and the fourth barrier wall is composed of one or more of the circular walls.

3. The silicon microphone as described in claim 2, wherein:

the circular wall is an uninterrupted continuous wall, or the circular wall is composed of a multi-section wall with gaps.

4. The silicon microphone as described in claim 1, wherein:

along the vibration direction of the diaphragm, the first barrier wall and the second barrier wall are staggered from each other, and the third barrier wall and the fourth barrier wall are staggered from each other;

the first barrier wall is close to the back cavity, and the second barrier wall and the fourth barrier wall are close to the narrow gap; the third barrier wall is close to the through hole on the backplate.

5. The silicon microphone as described in claim 1, wherein:

a relationship between a height h1 of the first barrier wall, a height h2 of the second barrier wall, and a distance L1 between the lower surface of the diaphragm and the upper surface of the base is:

$$L1/3 \le h1 \le 2 \times L1/3,\ L1/3 \le h2 \le 2 \times L1/3,\ L1 = h1 + h2.$$

6. The silicon microphone as described in claim 1, wherein:

a relationship between a height h3 of the third barrier wall, a height h4 of the fourth barrier wall and a distance L2 between the upper surface of the diaphragm and the lower surface of the backplate is:

$$L2/3 \le h3 \le 2 \times L2/3,\ L2/3 \le h4 \le 2 \times L2/3,\ L2 = h3 + h4.$$

* * * * *